United States Patent [19]

Rikon

[11] 4,136,880

[45] Jan. 30, 1979

[54] FOUR HAND CHECKERBOARD

[76] Inventor: Eli Rikon, 141-47 70th Rd., Flushing, N.Y. 11367

[21] Appl. No.: 819,128

[22] Filed: Jul. 26, 1977

[51] Int. Cl.[2] ..... A63F 3/02

[52] U.S. Cl. ..... 273/261

[58] Field of Search ..... 273/131 KP, 131 KN, 273/131 K, 131 AB, 136 G, 136 GB, 261

[56] References Cited

U.S. PATENT DOCUMENTS

| | | | |
|---|---|---|---|
| 386,007 | 7/1888 | Gibford | 273/131 KP |
| 701,414 | 6/1902 | Standidge | 273/131 KP |
| 1,202,191 | 10/1916 | King | 273/131 KP |
| 1,555,937 | 10/1925 | Billman | 273/131 KP |
| 3,998,464 | 12/1976 | Poturalski | 273/131 KN |

*Primary Examiner*—Paul E. Shapiro
*Assistant Examiner*—Harry G. Strappello

[57] ABSTRACT

A checkboard game utilizing four sets of checkers which can be placed on a checkerboard playing field. The playing field includes an odd number of rows and columns of checker squares, with a minimum of 13 such squares in a row. The four corners of the playing field are devoid of the checkerboard arrangement and are of a size whereby the opposing sides of the playing field which receive initial placement of the checkers are offset from each other and whereby opposing playing pieces symmetrically lie along the same rows and columns.

4 Claims, 3 Drawing Figures

FOUR HAND CHECKERBOARD

BACKGROUND OF THE INVENTION

1. Field of the Invention

This invention relates to a game and more particularly to a four hand checkboard game which provides increased challenge and complexity which demands a higher degree of competence and skill to thereby maintain the interest of the players.

2. Description of the Prior Art

One of the oldest games is the game of checkers. As is well known, the game is placed on a playing field of checkboard arrangement with eight rows and eight columns of individual playing squares. Two sets of checkers with each set having twelve individual checker pieces, are placed on the checkerboard in order to play. The checkers are initially arranged to occupy three rows on opposing sides of the playing field leaving the center two rows free for movement of the checker pieces.

Numerous variations of the basic checker game are also well known in the art. One such variation is to provide a four handed checkboard game which can be utilized with four or less players. In utilizing such four handed checkboard game, it is evident that four sets of checkers must be placed on the playing field. As a result, additional room must be provided for the additional sets of pieces.

In order to accommodate the additional checkers by making additional room, the first approach would be to expand the rows and columns of the checkerboard and make the entire playing field larger. However, in so doing, the typical three row checker arrangement for initial starting of the game would no longer be practical. By making the rows and columns longer the twelve checkers could then fit within two, or even one row or column and this would no longer provide the usual checkerboard game style and challenge. To solve this problem, most four hand checkerboard games provide a basic central playing field and extend a rectangular area, in a tabular fashion, for each of the four sides. The checkers are initially placed on these extend rectangular areas and then moved onto the central playing field. One such typical arrangement is shown in U.S. Pat. No. 1,555,937. In that patent, there is provided a checkerboard playing field having a square central area with an individual rectangular area extending from each of the sides of the central playing field on which the checker pieces are initially placed at commencement of the game.

Although the particular shape and size of the playing field may vary, this approach has been uniformly accepted for any four hand checkerboard. For example U.S. Pat. No. 694,509 similarly provides a central playing field with individual oblong fields extending from each edge of the central playing field in order to accommodate the three rows of checkers at commencement of the game.

While the aforementioned patents utilize the basic rules of checkers, other variations of the game are provided which modify the rules and modify the gameboard. For example, U.S. Pat. No. 386,007 provides a checkerboard playing field with extensions protruding from a central portion wherein opposing extensions are offset from each other. However, this patent does not provide the general checkboard game rules nor does it provide a uniform checkboard arrangement on the playing field. Instead, it modifies the game wherein the checkers seek a central goal area on the playing field and the arrangement of the checkerboard pattern is modified to provide the central goal area on the playing field.

However, it is evident that those prior art games providing four hand checkers utilizing the standard regulation checker game rules consistently provide an even number of rows and columns. Only where the basic checker game is modified and the checkerboard must accordingly also be modified to provide an unusual type of game movement is there provided an odd number of rows and columns. However, wherever the regulation checker game is being utilized an even number is always provided.

SUMMARY OF THE INVENTION

It has presently been found, that by utilizing an odd number of rows and columns, and specifically at least 13 such rows and columns, a unique, challenging and exceptionally intriguing game of four hand checkers can be provided. By utilizing such a playing field having an odd number of rows and columns, and specifically of 13 or more, the corners of the playing field are made devoid of the checkerboard arrangement in such a manner that opposing sides of the playing field are offset from each other by one row or column. This arrangement provides a unique overlap of checker pieces which adds to the challenge and complexity of the game making it more interesting and uniquely attractive to those skilled in the art of checkers.

It is therefore an object of the present invention to provide a four hand checkerboard game utilizing a uniquely arranged checkerboard with four sets of checkers. Another object of the present invention is to provide a game having a game board with a uniquely arranged checkerboard pattern to provide additional challenge and intrigue to the game of checkers.

Yet a further object of the present invention is to provide a uniquely designed checkerboard playing field which provides for four handed checkerboard playing.

Briefly, there is provided a game including a game board and four sets of distinguishingly identifiable playing pieces. The game board includes a square playing field which is divided into a checkerboard arrangement of $2n + 1$ playing squares arranged along rows and columns of the playing field wherein n is an interger equal to or greater than 6. The playing squares are alternately identified by contrasting colors. The four corners of the square playing field are devoid of the checkerboard arrangement. The first diagonally opposed corners each occupy the space of three columns and two rows of playing squares. The other diagonally opposed pair of corners each occupy the space of two columns and three rows of playing squares. With the exception of these corners, the checkerboard arrangement is uniform throughout the playing field.

The aforementioned objects, features and advantages of the invention will, in part, be pointed out with particularity, and will, in part, become more obvious from the following more detailed description of the invention, taken in conjunction with the accompanying drawings, which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENT

Figure 1:
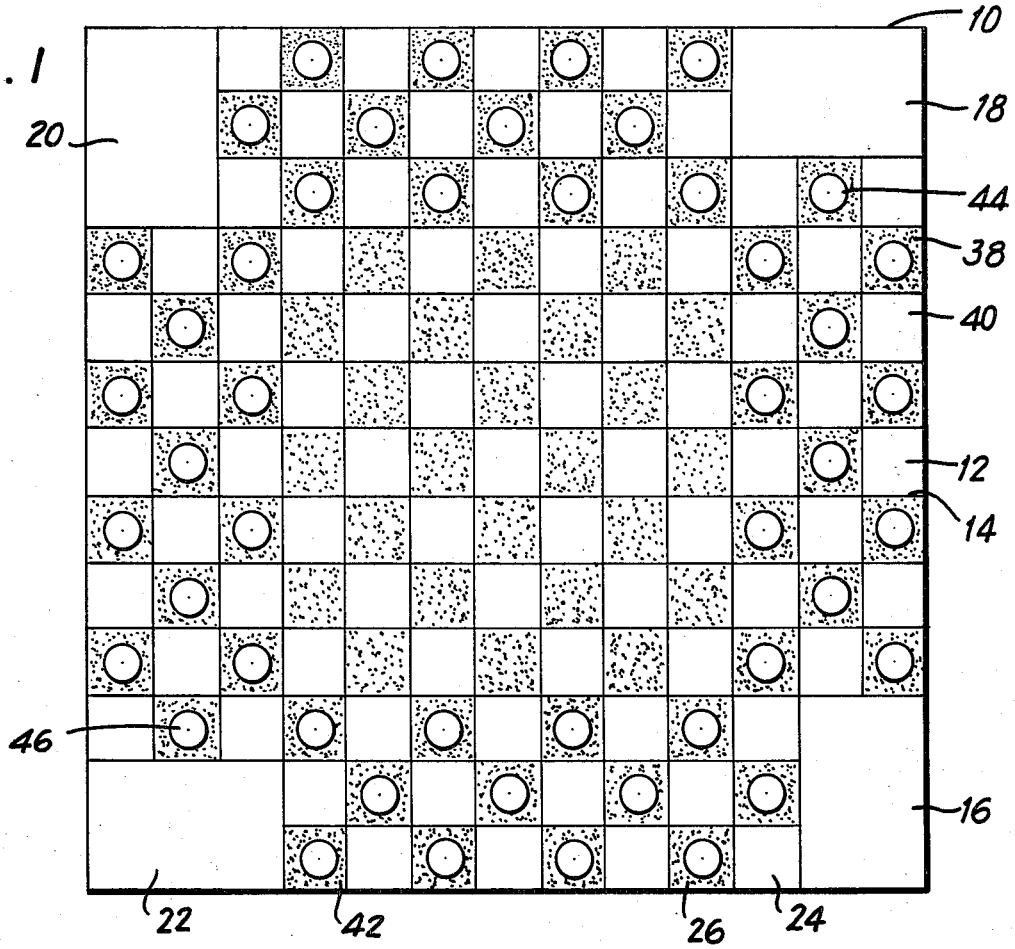
FIG. 1 is a plan view of the gameboard.

In the standard regulation type of checkers, there is provided a playing field having eight rows and eight columns. At the commencement of the game the twelve playing checker pieces of each set are arranged to occupy the three rows on either side of the checkerboard. With this arrangement, in a single column there will be two playing pieces from one set of checkers while at the opposite side of the board in the same column there will only be one checker playing piece. In the next column the first set will only have one playing piece while the checkers on the opposing set will have two checkers in that same column. This pattern is continued throughout the initial setup of the checkerboard. It will therefore be appreciated, that when a checker exists in the innermost row of one set, no checker will appear in the innermost row of the opposing set but will rather appear in the second row of the opposing set. This arrangement of the checkers at the commencement of the game has been universally accepted as the standard method of playing checkers.

When expanding the checker game into a four handed arrangement, the prior art patents had all provided rectangular extensions at the four sides to accommodate the initial placement of the checkers. However, in this arrangement, as well as on the playing field, the above mentioned standard method of setting the pieces and playing the pieces has been accepted. Specifically, an even number of rows and columns is always utilized whereby in a single column the number of playing pieces of one set will not be equal to the number of playing pieces in the set across the opposite side of the board. In other words, the initial arrangement of the checkers will be staggered whereby one set has more number of pieces in a given column than the opposing set. This can be recognized from the aforementioned U.S. Pat. Nos. 694,509 and 1,555,937. Heretofore, the only time the checkerboard arrangement was modified to provide an odd number of rows and columns was when the standard checker game was being modified and accordingly modification of the checkerboard was needed. For example, the aforementioned U.S. Pat. No. 386,007 provides a change in the usual checker game wherein kings are obtained at a central goal portion. In order to achieve the central goal portion on the playing field, an even number of rows and columns could not be utilized since the central goal portion could not then be obtained. Only for that reason was it necessary to modify the checkerboard arrangement and instead of providing the usual even number of rows and columns an odd number was provided whereby the central column could be subdivided. Furthermore, the checkerboard arrangement was modified so that it was not uniformly provided throughout the playing field but was distributed in the central portion to provide the goal.

However, in each instance where standard checker game rules were being utilized, the accepted even number of rows and columns were always provided in order to have opposing checker pieces initially set in an offset arrangement from each other.

It has now been found that a more intriguing and challenging game of checkers can actually be achieved by utilizing an odd number of rows and columns. Specifically, in connection with four hand checkers, wherein four sets of checker pieces are utilized and providing a total of $2n + 1$ rows and columns, wherein n is at least 6, the game is of extreme complexity to challenge even the most skillful checker player. Additionally, in order to provide the availability of having the checker pieces arranged in three rows and columns at the start of the game, the corners of the playing field are devoid of checkers. However, the corners are arranged in such a fashion so as provide the ends of the playing field in offset relationship on opposing sides. Utilizing this arrangement, when the checkers are initially positioned at the commencement of the game, there will be the same number of playing pieces across opposite sides of the board in a single column. Thus, a column which contains two playing pieces of one set will also have the two playing pieces of the opposing set in the same column. A column which has one playing piece from one set will have only one playing piece from the opposing set in the same column.

Figure 2:
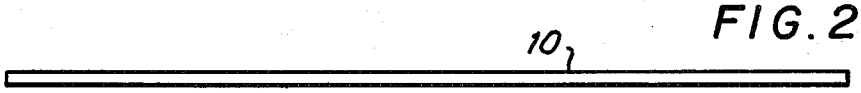
FIG. 2 is a side elevational view of the gameboard.

More specifically, with reference now to FIGS. 1 and 2 there is provided a gameboard shown generally at 10 which can be formed of cardboard, wood, paper, or any flat material. The gameboard includes a square playing field which is subdivided into individual playing squares 12 by having a grid arrangement of lines 14 separating the field into the individual playing squares. The playing field is formed into rows and columns wherein there is provided a total of 13 rows and 13 columns along substantially most of the playing field.

The only portion of the playing field not having the checkerboard arrangement are the corners. Specifically, the corner 16 is of a size covering three rows and two columns in area. The corner 18, on the other hand, covers two rows and three columns. The corner 20, similar to the corner 16, covers a space of three rows and two columns. The last corner, 22, similar to corner 18 covers two rows and three columns.

All of the playing field, with the exception of the corners, is arranged in checkerboard fashion whereby the squares are alternately identified by contrasting colors. Specifically, adjacent squares 24 and 26 are distinguished whereby one is made of a white color and the other of a black color. However, other distinguishingly contrasting colors can be utilized, as is well known in the art. The four corners, which are devoid of the playing squares, are of a solid arranged color. However, other designs could be placed in the corners as long as they do not include the same checkerboard pattern as the rest of the playing field.

With the arrangement as shown, it will be noted that there is provided an inner playing field with peripherally extending portions. However, opposing peripheral extensions are offset from each other. Specifically, on the right hand side of the board it is noted that the extension commences two rows from the top while on the left hand portion it commences three rows from the top. Similarly, each of the opposing peripheral portions are offset with respect to the one on the opposite side of the board.

Figure 3:
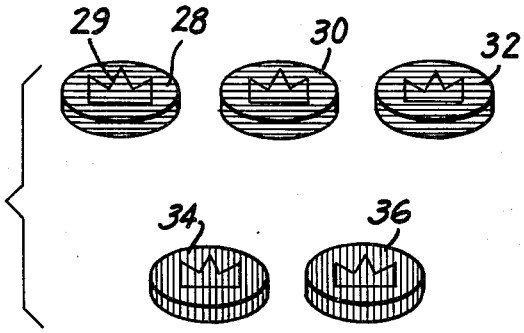
FIG. 3 is a perspective view of some of the checker playing pieces.

In conjunction with the game board there is provided four sets of distinguishingly identifiable playing pieces. As shown in FIG. 3, the playing pieces are each round checkers 28 having a design 29 thereon. The checkers are arranged so that there are twelve individual playing checkers in each set. The sets can be distinguished from each other by color or other means. As shown in FIG. 3, the three checkers 28, 30 and 32 are all shown of one color belonging to a first set while the checkers 34 and 36 are shown in a second color belonging to a second set. The other two sets would have distinguishing colors from these two.

In commencing the game, the twelve checkers are arranged as shown in FIG. 1. Specifically, they are arranged in accordance with the usual checker game set up having the twelve checkers occupy three rows or columns at the periphery of the board. However, it will be noted, that in setting up this game, contrary to the usually well accepted standard principles of checkerboard playing, there are the same number of checkers from opposing sides along a single column and row. More specifically, in the row identified as 38 there will be seen two white checkers at the right side of the board and at the same time two green checkers along the opposite side of the board. In the row identified as 40, there is a single white checker and a single opposing green checker. Similarly, for the rest of the rows. The columns in a likewise similar manner, have the same arrangement. For example, column 42 has two black checkers and on the opposite side two red checkers. Similarly for the other columns. The only exception is with regard to the single checkers contained in the offset rows and columns. For example, the white checker 44 is the only one in that row, the green checker 46 is the only one in that row and similarly for the red and black checkers in their respective columns. It should be noted that this is contrary to the usual accepted method of setting up a checker game.

Additionally, because of the offset arrangement in the playing field peripheral areas, it will be noted that the offset white checker 44 is actually along the same row as the line of red checkers. Similarly, the offset black checker is in the same column as the white checkers. This offset arrangement provides a further intermingling of the checkers to provide additional interaction of the checker pieces whereby further challenge will be had to the game of four handed checkers.

It has been found that because of this odd number of squares which form the same number of checkers on opposing sides of columns and rows, there is increased challenge to the skill of the player. Furthermore, by providing the offset arrangement causing in interaction of the sets of checkers, still additional challenge is provided. The four handed checkerboard game is played with four or less people, one person being on each side of the board. Each person makes a move in consecutive order starting from a first player and moving around either clockwise or counter clockwise arrangement. The usual diagonal checkerboard moves are utilized for each playing piece and each piece can jump and thereby remove any other playing piece of any other color. A king can be obtained by having a checker of one color reach any of the other three sides of the board. For example, the green checkers are moved in such a manner that it can obtain a king by reaching the black side, the white side, or the red side. The game continues in consecutive fashion with each player moving and jumping, as available, until the last man remains.

Although the play can be continued until only one player remains, it has been found that when two players are left, the game becomes of less interest and the one player that has the most number of checkers left is declared the winner. This is because the board is larger than the conventional checkerboard and with two players alone the game is of less challenge. In addition to having four individual players the game can be played as partners with players across from each other being partners or diagonal players being partners.

Although the size of the board and the checker squares can be modified, the size of the checkers are such that they fit within the playing squares. While additional odd number of rows and columns can be utilized, such as 17, 15, etc. it has been found that the 13 columns and 13 rows as shown provides a most beneficial game with a unique amount of challenge and intrigue for even skilled players.

There has been disclosed heretofore the best embodiment of the invention presently contemplated. However, it is to be understood that various changes and modifications may be made thereto without departing from the spirit of the invention.

I claim:

1. A game comprising a gameboard having a square playing field divided into a checkerboard arrangement of $2n + 1$ playing squares along rows and columns of the playing field, wherein n is an integer equal to or larger than 6, said playing squares being alternately identified by contrasting colors, alternate ones of the playing squares being playing piece receiving squares with the rest of the playing squares being spacing squares, the four corners of said square playing field being devoid of said checkerboard arrangement of which a first diagonally opposed pair of corners each occupy the space of three columns and two rows of playing squares and the other diagonally opposed pair of corners each occupy the space of two columns and three rows of playing squares, with the exception of said corners said checkerboard arrangement being uniform throughout the playing field, the corners being arranged such that a player facing any side of the gameboard has the left hand corner devoid of playing squares in the area of two vertical and three horizontal playing squares and the right hand corner devoid of playing squares in the area of three vertical and two horizontal playing squares, the checkerboard arrangement being such that the respective first playing squares on the playing field along an imaginary diagonal line crossing each of said four corners is a playing piece receiving square, and four sets of playing pieces, each set being distinguishable from the other of said sets, each playing piece fitting within a playing square.

2. A game as in claim 1 and wherein each set of playing pieces comprise twelve substantially identical individual playing pieces.

3. A game as in claim 1 and wherein $n = 6$.

4. A game as in claim 1 and wherein the peripheral checkerboard sections of opposing sides are offset from each other, and whereby the sets of playing pieces are initially positioned on the peripheral sections of the checkerboard arrangement in such a manner that the same number of playing pieces are placed on identical rows and columns on opposite sides of the playing field.

* * * * *